US007249705B2

(12) United States Patent
Dudley

(10) Patent No.: US 7,249,705 B2
(45) Date of Patent: Jul. 31, 2007

(54) THEFT PREVENTATIVE MAILBOX HAVING REMOTE UNLOCKING ACTIVATION MECHANISM

(76) Inventor: Joseph Dudley, 1109 Chapel Creek Ct., Richardson, TX (US) 75093

( * ) Notice: Subject to any disclaimer, the term of this patent is extended or adjusted under 35 U.S.C. 154(b) by 1 day.

(21) Appl. No.: 11/161,416

(22) Filed: Oct. 26, 2005

(65) Prior Publication Data

US 2006/0113368 A1 Jun. 1, 2006

Related U.S. Application Data

(60) Provisional application No. 60/649,600, filed on Feb. 4, 2005, provisional application No. 60/631,366, filed on Nov. 29, 2004.

(51) Int. Cl.
*B65G 11/04* (2006.01)

(52) U.S. Cl. ..... 232/47; 232/45; 340/5.7; 340/5.6; 340/569

(58) Field of Classification Search ..... 232/47, 232/45, 17, 19; 340/568.1, 569, 5.6, 5.7, 340/5.73

See application file for complete search history.

(56) References Cited

U.S. PATENT DOCUMENTS 516,890 A * 3/1894 Hentz ..... 232/35
4,154,393 A 5/1979 Darvishian
5,148,974 A * 9/1992 Clapper ..... 232/17
5,435,484 A * 7/1995 Carlson ..... 232/47
5,475,378 A 12/1995 Kaarsoo
5,774,053 A * 6/1998 Porter ..... 340/568.1
5,833,132 A * 11/1998 Bachmeier ..... 232/47
5,850,967 A 12/1998 White
5,954,264 A 9/1999 Keller
6,375,071 B1 * 4/2002 Kim ..... 232/47
6,533,167 B2 3/2003 Hassan
6,715,669 B2 4/2004 Hara
6,840,438 B2 1/2005 Hassan
6,942,141 B2 * 9/2005 Swift ..... 232/47
6,957,767 B2 * 10/2005 Aupperle et al. ..... 232/45
7,036,719 B1 * 5/2006 Helphrey et al. ..... 232/47
2002/0067261 A1 6/2002 Kucharczyk
2004/0074957 A1 4/2004 Devar
2004/0084276 A1 5/2004 Repic
2004/0122780 A1 * 6/2004 Devar ..... 705/405

* cited by examiner

*Primary Examiner*—William L. Miller
(74) *Attorney, Agent, or Firm*—Michael Cameron, Esq.

(57) ABSTRACT

What is disclosed is a secure mailbox having at least a main compartment with a plurality of sides forming the enclosed main compartment, a front mailbox door hingedly coupled to the remainder of the main compartment, a locking and unlocking mechanism being adapted to lock the front mailbox door to the main compartment and an unlocking activation mechanism coupled to the locking and unlocking mechanism comprised of either a card key system, a FOB system or an RFID system.

11 Claims, 3 Drawing Sheets

THEFT PREVENTATIVE MAILBOX HAVING REMOTE UNLOCKING ACTIVATION MECHANISM

CROSS REFERENCE TO RELATED APPLICATIONS

This application claims the benefit of U.S. Provisional Application No. 60/631,366 filed on Nov. 29, 2004, entitled "Secure Card Lock, and Key Lock, Curbside Mailbox—Residential" and U.S. Provisional Application No. 60/649,600, filed on Feb. 4, 2005, entitled "Secure FOB/Wand Locking Curbside Mailbox—Residential."

TECHNICAL FIELD

The present invention relates to mailboxes and particularly to theft preventative mailboxes having a card key, FOB and radio frequency ID unlocking activation mechanisms.

BACKGROUND OF THE INVENTION

The information explosion, aided by easily obtainable credit, has led to a dramatic increase in identity theft. Identity theft is a crime that feeds on the inability of consumers to control who has access to sensitive information and how it is safeguarded. According to the Identity Theft Center, identity theft remains the primary concern among consumers contacting the Federal Trade Commission. According to two (2) studies done in July 2003 by Gartner Research and Harris Interactive, approximately 7 million people became victims of identity theft in the prior 12 months, equal to 19,178 victims per day, 799 victims per hour, 13.3 victims per minute. The incidence of victimization increased 11 to 20% between 2001 and 2002 and 80% between 2002 and 2003 according to the Harris Interactive survey. This same study found that 91% of respondents do not see an "end to the tunnel" and expect a heavy increase in victimization. 49% also stated that they do not feel they know how to adequately protect themselves from this crime. Victims currently spend an average of 600 hours recovering from identity theft, often over a period of years. In 2002, the average was 175 hours of time, representing an increase of about 2470%. Based on 600 hours times the indicated victim wages, this equals nearly $16,000 in lost potential or realized income. While victims are finding out about the crime more quickly, it is taking much longer to clear their records and recover from the crime. Even after the thief stops using the information, victims struggle with the impact of identity theft. Effects of being a victim include increased insurance or credit card fees, inability to find a job, higher interest rates and battling collection agencies and issuers who refuse to clear records despite substantiating evidence of the crime. This effect may continue for more than 10 years after the crime was first discovered. Approximately 85% of victims found out about the crime due to an adverse situation such as denied credit or employment, notification by police or collection agencies, receipt of credit cards or bills never ordered and the like. Only 15% found out through a positive action taken by a business group that verified a submitted application or a reported change of address. The easiest way that thieves have access to personal identification such as pre-approved credit card applications is through theft of mail from unlocked mailboxes.

Module D of the United States Postal Service Domestic Mail Manual sets forth the requirements for customer deposit of mail and basic information on how the Postal Service collects and delivers mail. Information about post office boxes is included in this module. Module D041 describes the standards for letterboxes or other receptacles for the deposit or receipt of mail. It also contains the standards for curbside mailboxes. Manufacturers of all mailboxes designed and made to be erected at the edge of a roadway or curbside of a street and to be served by a carrier from a vehicle on any city route, rural route, or highway contract route must be approved under USPS Standard 7, Mailboxes, City and Rural Curbside. Conventional mailboxes with a lock must have a slot that is large enough to accommodate the customer's normal daily mail volume as the USPS currently neither opens a locked box nor accepts a key for this purpose.

The prior art is well documented with varied examples of mailbox storage and mailbox theft preventative assemblies. The objective in each of these instances is to safeguard the mail from the time the mail delivery person deposits the mail until the time addressee has time to collect the mail.

None of the conventional mailbox storage and mailbox preventive assemblies allow for a normal receptacle opening or front mailbox door that can be locked and remotely unlocked. If such a mailbox were available, both incoming and outgoing mail could be safeguarded. What is desired is a preventative mailbox that can be unlocked and locked with a minimum of effort on behalf of the postal employee and the addressee. It is an objective of the present invention that such a mailbox would be accepted by the USPS in order to combat the rise in identification theft.

SUMMARY OF THE INVENTION

In a first embodiment of the present invention, a curbside mailbox with an unlocking mechanism that is activated using a card key is provided.

In a second embodiment of the present invention, a curbside mailbox is provided having a secure drop box with a first trap door mechanism, the curbside mailbox having an unlocking mechanism that is activated using a card key.

In a third embodiment of the present invention, a curbside mailbox is provided having a secure drop box with a second trap door mechanism, the curbside mailbox having an unlocking mechanism that is activated using a card key.

In a fourth embodiment of the present invention, a curbside mailbox having an unlocking mechanism that is activated using a FOB is provided.

In a fifth embodiment of the present invention, a curbside mailbox is provided having a secure drop box with a first trap door mechanism, the curbside mailbox having an unlocking mechanism that is activated using a FOB.

In a sixth embodiment of the present invention, a curbside mailbox is provided having a secure drop box with a second trap door mechanism, the curbside mailbox having an unlocking mechanism that is activated using a FOB.

In a seventh embodiment of the present invention, a curbside mailbox with an unlocking mechanism that is activated using an RFID system is provided.

In a eighth embodiment of the present invention, a curbside mailbox is provided having a secure drop box with a first trap door mechanism, the curbside mailbox having an unlocking mechanism that is activated using an RFID system.

In a ninth embodiment of the present invention, a curbside mailbox is provided having a secure drop box with a second trap door mechanism, the curbside mailbox having an unlocking mechanism that is activated using an RFID system.

In a tenth embodiment of the present invention, a non-curbside mailbox, such as a vertical, vault-type or cluster box, with an unlocking mechanism and that is activated using a card key system, FOB system or RFID system is provided.

Each embodiment described herein has advantages over the conventional secure and unsecured mailboxes, the primary advantage being the ability to have a standard size mailbox in which both incoming and outgoing mail can be secured. These and many other advantages related to the present invention will become apparent to persons skilled in the relevant arts through careful reading of the disclosure and claims presented herein.

BRIEF DESCRIPTION OF THE DRAWINGS

For a better understanding of the present invention including the features, advantages and specific embodiments, reference is made to the following detailed description along with accompanying drawings in which.

References in the detailed description correspond to like references in the Figures unless otherwise noted. Like numerals refer to like parts throughout the various Figures. Descriptive and directional terms such as top, bottom, left, right, first, second, refer to the drawings themselves as laid out on the paper and not to physical limitations of the invention unless specifically noted.

DETAILED DESCRIPTION OF PREFERRED EMBODIMENTS

While the making and using of various embodiments of the present invention are discussed in detail below, it should be appreciated that the present invention provides many applicable inventive concepts which can be embodied in a wide variety of specific contexts. Some features of embodiments shown and discussed are simplified or exaggerated for illustrating the principles of the invention.

Figure 1:
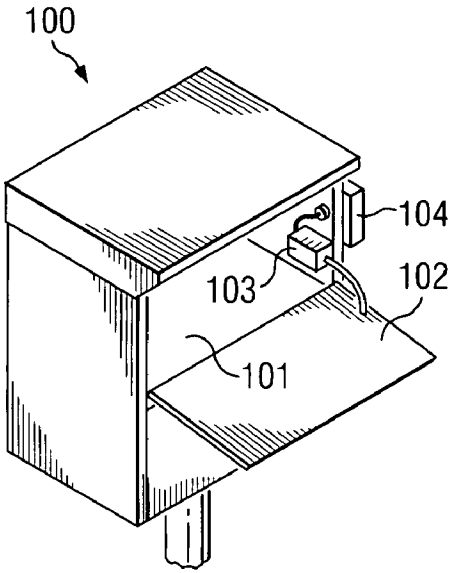
FIG. 1 is a view of a mailbox of the present invention with a locking and unlocking mechanism and a generic remote unlocking activation mechanism.
Figure 4:
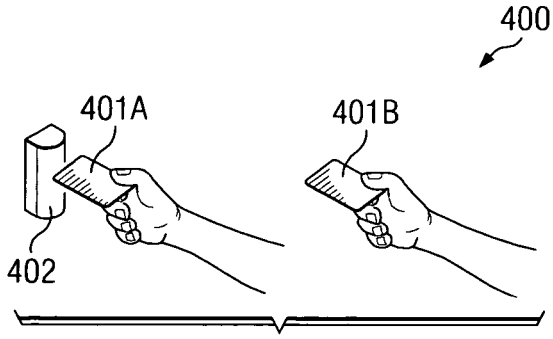
FIG. 4 is a view of a card key locking and unlocking activation system.
Figure 5:
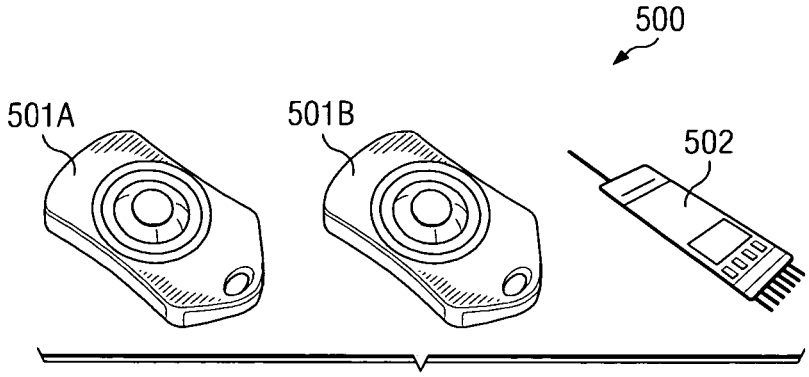
FIG. 5 is a view of a FOB locking and unlocking activation system.
Figure 6:
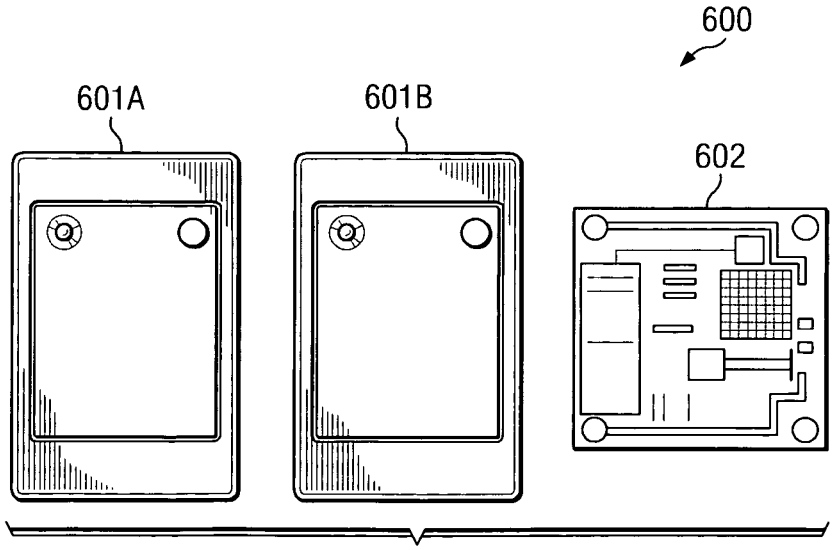
FIG. 6 is a view of an RFID locking and unlocking activation system.

Referring now to FIG. 1, the secure mailbox 100 of the present invention comprises at least a main compartment 101 having a plurality of sides forming the enclosed main compartment 101, a front mailbox door 102 hinge-ably coupled to the remainder of the main compartment 101, a locking and unlocking mechanism 103 being adapted to lock the front mailbox door 102 to the main compartment 101 and an unlocking activation mechanism 104 coupled to the locking and unlocking mechanism 103, said unlocking activation mechanism 104 comprised of either a card key system 400, a FOB system 500 or an RFID system 600, as seen in FIGS. 4, 5 and 6. The locking and unlocking mechanism 103 is adapted to be unlocked remotely using the unlocking activation mechanism 104, and once the front mailbox door 102 is closed, the locking and unlocking mechanism 103 is adapted to automatically lock.

Referring now to FIG. 1, the secure mailbox 100 of the present invention comprises at least a main compartment 101 having a plurality of sides forming the enclosed main compartment 101, a front mailbox door 102 hingedly coupled to the remainder of the main compartment 101, a locking and unlocking mechanism 103 being adapted to lock the front mailbox door 102 to the main compartment 101 and an unlocking activation mechanism 104 coupled to the locking and unlocking mechanism 103, said unlocking activation mechanism 104 comprised of either a card key system 400, a FOB system 500 or an RFID system 600, as seen in FIGS. 4, 5 and 6. The locking and unlocking mechanism 103 is adapted to be unlocked remotely using the unlocking activation mechanism 104, and once the front mailbox door 102 is closed, the locking and unlocking mechanism 103 is adapted to automatically lock.

Figure 2A:
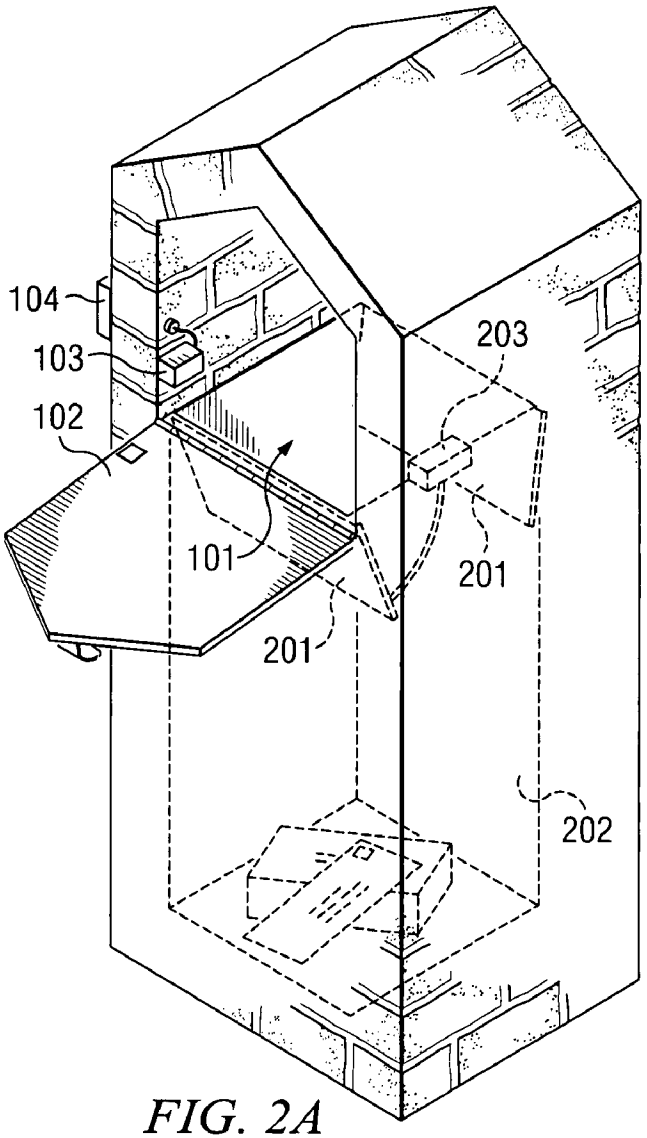
FIG. 2A is a front view of the curbside mailbox with a secure drop box of the present invention with the front mailbox door in the open position and FIG. 2B is a front view of the curbside mailbox with a secure drop box of the present invention with the front mailbox door in the closed position.
Figure 3:
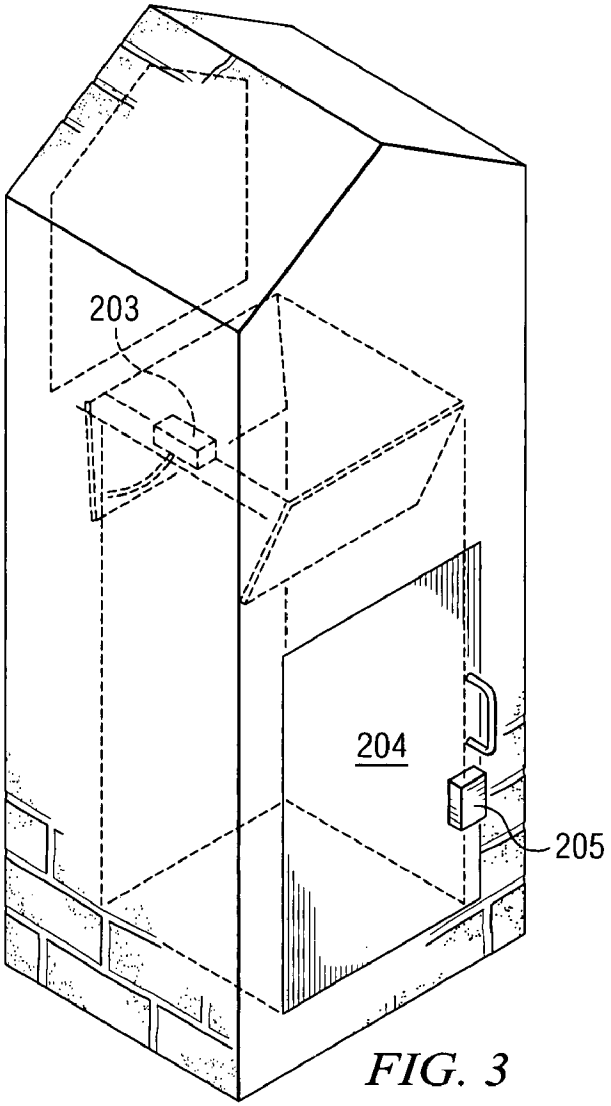
FIG. 3 is a back view of the curbside mailbox with a secure drop box of the present invention illustrating the drop box door.
Figure 2B:
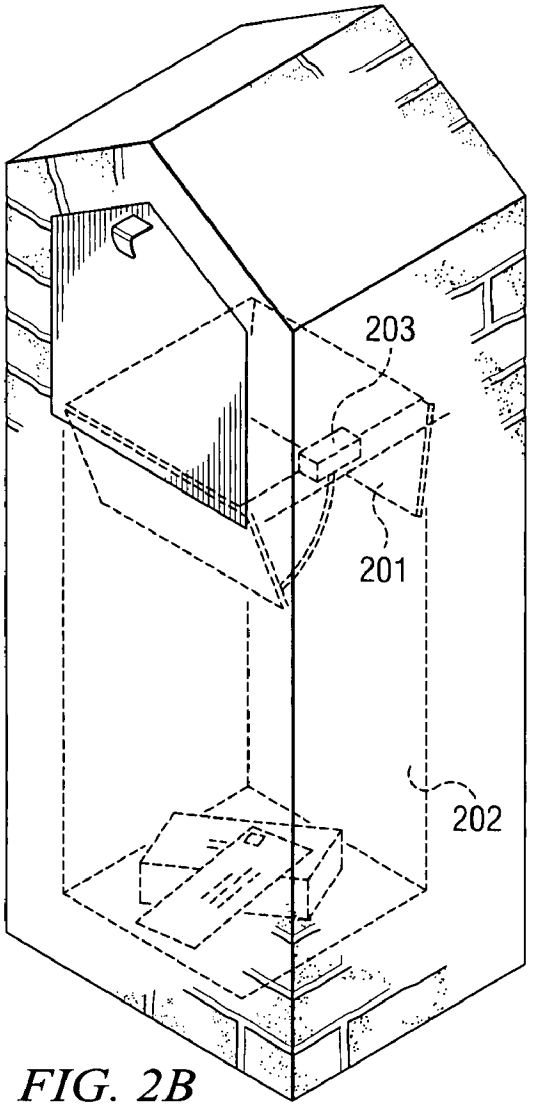

The second, third, fifth, sixth, eighth and ninth embodiments of the mailbox of the present invention have a secure drop box compartment 202 comprising a plurality of sides. Referring now to FIGS. 2A, 2B and 3, in said embodiments, at least one trap door 201 is hinge-ably coupled between the main compartment 101 and the secure drop box compartment 202. The trap door(s) 201 are adapted to rotatably open and allow packages or other items in the main compartment 101 to fall into the secure drop box compartment 202 when the trap door(s) 201 are released. The secure drop box compartment 202 is dimensioned to store several days of mail. Thus, it eliminates the need to have the post office to hold an addressee's mail while the addressee is away from home. The secure drop box compartment 202 is also dimensioned to accommodate small to medium sized packages thus eliminating the need for the postal employee to bring such packages to an addressee's front door. The use of a secure drop box compartment 202 further reduces the possibility of theft of a package which would otherwise have to be left at the door when the addressee is not at home. The present invention also overcomes the need for the postal employee to return the package to the post office, eliminating the requirement of writing a notice to the addressee to retrieve the package.

The second, third, fifth, sixth, eighth and ninth embodiments of the mailbox of the present invention have a secure drop box compartment 202 comprising a plurality of sides. Referring now to FIGS. 2A, 2B and 3, in said embodiments, at least one trap door 201 is hingedly coupled between the main compartment 101 and the secure drop box compartment 202. The trap door(s) 201 are adapted to rotatably open and allow packages or other items in the main compartment 101 to fall into the secure drop box compartment 202 when the trap door(s) 201 are released. The secure drop box compartment 202 is dimensioned to store several days of mail. Thus, it eliminates the need to have the post office to hold an addressee's mail while the addressee is away from home. The secure drop box compartment 202 is also dimensioned to accommodate small to medium sized packages thus eliminating the need for the postal employee to bring such packages to an addressee's front door. The use of a secure drop box compartment 202 further reduces the possibility of theft of a package which would otherwise have to be left at the door when the addressee is not at home. The present invention also overcomes the need for the postal employee to return the package to the post office, eliminating the requirement of writing a notice to the addressee to retrieve the package.

The trap door mechanism 203 can be implemented in a variety of ways. The trap door mechanism 203 can be in a default closed position so that outgoing mail can be placed into the main compartment 101 at any time. Alternatively, the trap door mechanism 203 can have the trap door(s) 201 in the default open position, with the trap door(s) 201 movable to the closed position by the addressee if the addressee desires to place outgoing mail in the main compartment 101. In either case, the trap door(s) 201 are adaptable to retain outgoing mail in the main compartment 101 and permit incoming mail to eventually fall into the secure drop box compartment 202. Although two trap door mechanisms are described below, there are a variety of different trap door mechanisms that can be used in the various embodiments of the present invention, all of which are covered by this present invention. The trap door(s) 201 can be comprised of a single door or it can be comprised of multiple trap doors, such as two halves that open in the center, such trap door(s) 201 and being hingedly coupled proximate the top of the secure drop box compartment 202.

Once packages and mail have fallen into the secure drop box compartment 202, the trap door(s) 201 return to the closed position leaving the incoming mail in the secure drop box compartment 202 until the addressee retrieves the mail by opening at least one drop box door 204 located on the backside of the mailbox.

The drop box door(s) 204 is hinge-ably connected to the secure drop box compartment 202 and is adapted to allow access into the secure drop box compartment 202. The drop box door(s) 204 includes a drop box door lock mechanism 205 that is secured by a key lock or is integral with the card key system 400, FOB system 500 or RFID system 600 unlocking activation mechanism 104 described herein. The drop box door(s) 204 can only be unlocked using the addressee's specific key, card key, FOB transmitter, RFID reader or override key. In the card key system, a contact reader can be used which comprises a slot located on the backside of the mailbox. When the addressee closes the drop box door(s) 204, the drop box lock mechanism 205 is adapted to automatically lock.

In a first embodiment of the present invention, a curbside mailbox with an unlocking activation mechanism 104 that is activated using a card key system 400 is provided. As seen in FIG. 4, the unlocking activation mechanism 104 can be comprised of a card key system 400 having a master coded card 401A, a subordinate card 401B retained by the addressee and a card reader 402, the card reader 402 being located at the mailbox and being coupled to the locking and unlocking mechanism 103. The card reader 402 would have a power source which can be the AC mains, a non-rechargeable or rechargeable DC battery source or a DC solar power source which is operable to power the card reader 402 directly or to recharge the rechargeable batteries. Card key systems can comprise a variety of technologies, such as contact, contactless (proximity), passive, active, magnetic, electronic, sonar and optical. Each of such implementation technologies is included within the purview of this invention.

The drop box door(s) 204 is hingedly connected to the secure drop box compartment 202 and is adapted to allow access into the secure drop box compartment 202. The drop box door(s) 204 includes a drop box door lock mechanism 205 that is secured by a key lock or is integral with the card key system 400, FOB system 500 or RFID system 600 unlocking activation mechanism 104 described herein. The drop box door(s) 204 can only be unlocked using the addressee's specific key, card key, FOB transmitter, RFID reader or override key. In the card key system, a contact reader can be used which comprises a slot located on the backside of the mailbox. When the addressee closes the drop box door(s) 204, the drop box lock mechanism 205 is adapted to automatically lock.

Active proximity technology implies there is a battery within the card 401A, 401B. Because the card 401A, 401B uses internal power, the range is greatly expanded from 3 to 15 feet in contrast to 1 to 5 inches with the passive card. The RF signal is low level, usually less than one milliwatt but the frequency used is much higher. With an active card reader system, orientation of the card and reader become important. Active technology is useful where a hands-free (as opposed to contact-less) data exchange is required. Read range is adjustable between 3 to 15 feet. Active cards are generally thicker (⅕ inch) as a result of the replaceable battery requirement. The postal employee would possess master card 401A that is operable to open the mailbox front door on all mailboxes along a route whereas the addressee would possess card 401B that is operable to open only their own mailbox front door 102 and/or drop box door 204, as described in more detail herein.

In operation, the addressee inserts their uniquely encoded subordinate card 401B into a slot, or places it in proximity to the card reader 402, to open the front mailbox door 102 and places the outgoing mail in the main compartment 101. By closing the front mailbox door 102, the locking and unlocking mechanism 103 will automatically lock the front mailbox door 102. The postal employee subsequently inserts a master card 401A in a card key slot or waves a master card 401A proximate to a reader near the front of the secure mailbox 100. The front mailbox door 102 will then be released for the postal employee to open and collect the outgoing mail. The card key reader or slot 402 preferably is in a weather resistant housing. A second embodiment of the present invention comprises the foregoing curbside mailbox but is also provided with a secure drop box compartment 202 with a first trap door mechanism 203. A third embodiment of the present invention comprises the first embodiment of the present invention also with a secure drop box compartment 202 with a second trap door mechanism 203.

In a fourth embodiment of the present invention, a curbside mailbox with an unlocking mechanism 104 that is activated using a FOB system 500 is provided. As seen in FIG. 5, the FOB system 500 has a master FOB transmitter 501A, and a subordinate FOB transmitter 501B retained by the addressee, either FOB transmitter being in a wand form factor or key chain form factor and a FOB receiver 502 coupled to the locking and unlocking mechanism 103 located at the mailbox 100. The FOB receiver 502 can be powered by a power source which can be an AC mains, a non-rechargeable or rechargeable DC battery source or a DC solar power source to power the FOB receiver 502 directly or to recharge the rechargeable batteries. The FOB transmitters 501A, 501B can be similarly powered. FOB transmitters 501A, 501B and corresponding FOB receiver 502 are conventionally available with a variety of functionalities. For purposes of this invention, a one function transmitter can be used for the remote control and command application. Typical compact keychain remotes are capable of transmission ranges up to 75 feet. The transmission from the FOB transmitters 501A, 501B can be decoded using a standard decoder integrated circuit, microcontroller, function module or receiver/decoder. Such FOB systems provide for selectable addressing to provide security and allows the creation of distinct transmitter/receiver relationships or one transmitter to many receiver relationships. In this manner, a single, secure master FOB transmitter 501A used by the postal service can be used to activate a number of FOB receivers 502, for example, along a route and each subordinate FOB transmitter 501B is operable only to open the addressee's specific mailbox. Such a unit can operate from a single 3-volt lithium cell. In a single function FOB system, the FOB receiver 502 can be a 7 pin module that plugs into a solderless bread board. The FOB transmitters 501A, 501B can have a single button, the FOB receiver 502 having a single output. While the button on the FOB transmitter 501A, 501B is pressed, the corresponding output goes high for the same duration of time, thus releasing the locking and unlocking mechanism 103 so as to allow access to the main compartment 101 of the mailbox 100 of the present invention. The addressee would use a subordinate FOB transmitter 501B that is operable only to open their own front mailbox door 102 and/or is operable only to open their own drop box door 204. One skilled in the art would appreciate that a variety of FOB systems can be used to implement this invention and each of such FOB systems are included within the purview of this invention.

In operation, the addressee will wave or otherwise activate their subordinate FOB transmitter 501B in the form factor of a key chain FOB or wand in front of a receiver pad antenna to open the front mailbox door 102 and will place outgoing mail inside. By closing the front mailbox door 102, the locking and unlocking mechanism 103 will automatically lock the front mailbox door 102. Subsequently, a postal employee can wave or otherwise activate the master FOB transmitter 501A or wand in front of the receiver pad antenna, thus activating the locking and unlocking mechanism 103 and releasing the front mailbox door 102. The postal employee can then open and collect the outgoing mail from the main compartment 101. The postal employee can then insert any new mail in the main compartment 101 and press a button or key on his/her master FOB transmitter 501A and close the front mailbox door 102. Once the front mailbox door 102 as been closed, trap door mechanism 203 can release the trap door(s) 201 so that incoming mail is dropped into the secure drop box compartment 202. Alternatively, the postal employee can push a release button or disc to cause the trap door mechanism 203 to release the trap door(s) 201 so that incoming mail is dropped into the secure drop box compartment 202. After a certain time delay, the trap door(s) 201 would return to the closed position, leaving the incoming mail in the secure drop box compartment 202. The addressee would then retrieve the mail from the secure drop box compartment 202 by unlocking and opening the drop box door 204 located on the backside of the mailbox 200. The FOB receiver is preferably located within a weather resistant housing. A fifth embodiment of the present invention comprises the foregoing curbside mailbox but is also provided with a secure drop box compartment 202 with a first trap door mechanism. A sixth embodiment of the present invention comprises the fourth embodiment of the present invention further comprising a secure drop box compartment 202 with a second trap door mechanism.

In a seventh embodiment of the present invention, a curbside mailbox with an unlocking mechanism 104 that is activated using an RFID system is provided. As seen in FIG. 6, the RFID system 600 has a master RFID transceiver 601A and a subordinate RFID transceiver 601B, each located remotely from the mailbox and an RFID module 602 located at the mailbox. Each RFID transceiver 601A, 601B can be powered by a power source which can be the AC mains, a non-rechargeable or rechargeable DC battery source or a DC solar power source to power the RFID transceivers 601A, 601B directly or to recharge the rechargeable batteries. RFID, which is an abbreviation for radio frequency identification, is a generic term that is used to describe a system that transmits the identity, in the form of a unique serial number, of an object wirelessly, using radio waves. In the case of the present invention, the object is each unique mailbox, or more specifically, the identification of the RFID module 602 within each specific mailbox. RFID is considered an automatic identification technology. RFID is designed to enable readers to capture data on objects and transmit it to a system without requiring the active involvement of a person.

A typical RFID module 602 consists of a microchip attached to a radio antenna mounted on a substrate. The chip can store as much as 2 kilobytes or more of data. For example, information about the mailbox can be written to the RFID module 602. To identify the mailbox to the postal employee, the postal employee must retrieve the data stored on the RFID module 602 using an RFID module reader, referred to as the master RFID transceiver 601A. Such a master RFID transceiver 601A can be portable or can be installed in a postal vehicle. A typical RFID transceiver is a device that has one or more antennas that emit radio waves and receive signals back from the RFID module 602. The RFID transceiver then passes the information in digital form to a CPU and memory having a look-up table. An acknowledgement from the CPU and memory that the postal employee can access the main compartment is sent back to the RFID module 602 thus unlocking the locking and unlocking mechanism 103. The postal employee's master RFID transceiver 601A and corresponding CPU and memory could be configured, through software programming or hardwiring, to allow access to any number of mailboxes, such as along a specific mail route. The addressee would likewise have a subordinate RFID transceiver 601B that is operable only to open their specific front mailbox door 102 and/or is operable to open the drop box door 204, as described in more detail herein. An eighth embodiment of the present invention comprises the foregoing curbside mailbox but is also provided with a secure drop box compartment 202 with a first trap door mechanism 203. A ninth embodiment of the present invention comprises the first embodiment of the present invention also with a secure drop box compartment 202 with a second trap door mechanism.

In any of the embodiments of the present invention which incorporate a secure drop box compartment, the secure drop box compartment is not accessible without a specifically encoded key, card key, override key, FOB transmitter or RFID transceiver. When the drop box door 204 is closed, the drop box lock mechanism 205 is adapted to automatically lock the drop box door 204.

In a tenth embodiment of the present invention, a non-curbside mailbox, such as a vertical, vault-type or cluster box, with an unlocking mechanism and that is activated using a card key 400, FOB system 500 or RFID system 600 is provided. Each of the embodiments of the present invention can have a variety of dimensions. A preferred set of dimensions are as follows: overall for the entire mailbox, including outside enclosure made of brick, stucco and the like: 50" high×24" wide×24" deep. The main compartment and secure lockbox compartment can have dimensions of 40" high×20" wide×20" deep. The embodiment that uses two(2) trap doors side by side that open at the middle, each can be dimensioned as 20" wide×10" long.

In one aspect of any of the embodiments, the post office can retain security responsibility for controlling the master codes or identifications used in the card key system, FOB system or RFID system. Different master codes can be assigned to individual routes and can be easily changed if security is compromised through the loss of code keys or any device that is used to activate a locking and unlocking mechanism. Such a system of codes (groups or subgroups of which can be identified by different colors) can be used for specific routes. In operation, each post office employee could have a master card key, FOB transmitter or RFID transceiver configured specifically for that route. The codes would only work with that particular route and would not correspond to mailboxes outside of that route.

Each of the embodiments of the present invention could include a device or module of sending a signal to the addressee or to a geographical location to indicate that mail has been left in the secure mailbox. This can be accomplished with a programmable control card, ID lights and an actuator.

There are numerous advantages of the present invention for the addressee. The present invention saves money and time for addressees who would otherwise travel to a post office to retrieve mail that had been placed on hold or who, for security reasons, must travel to postal drop boxes located at, for example, strip shopping malls to deposit outgoing mail. It also avoids the burden of having to request that a neighbor or acquaintance pick up mail while the addressee is away from home.

The embodiments shown and described above are only exemplary. Even though numerous characteristics and advantages of the present invention have been set forth in the foregoing description together with details of the method of the invention, the disclosure is illustrative only and changes may be made within the principles of the invention to the full extent indicated by the broad general meaning of the terms used in the attached claims.

What is claimed is:

1. A secure mailbox, comprising:

a main compartment having a plurality of sides forming an enclosed main compartment;

a front mailbox door hingedly connected to the remainder of said main compartment;

a locking and unlocking mechanism being adapted to lock the front mailbox door to said main compartment when the front mailbox door is in the closed position;

an unlocking activation mechanism coupled to the locking and unlocking mechanism adapted to unlock the front mailbox door;

said unlocking activation mechanism comprising a card key system; wherein the card key system comprises at least one master card encoded with a plurality of unique identifiers and at least one subordinate card encoded with a subset of the unique identifiers; and a card reader located proximate to the mailbox and coupled to the locking and unlocking mechanism, said card reader operable to unlock the front mailbox door upon receiving a signal from the master encoded card or subordinate card a secure drop box compartment located below the main compartment; at least one drop box door hingedly connected to the secure drop box compartment; and the at least one drop box door adapted to lock when in a closed position; and at least one trap door operable by a trap door mechanism; the at least one trap door located between the main compartment and the secure drop box compartment; the trap door mechanism operatively coupled to the card key system such that after a predetermined amount of time elapses after the card key system is activated, the at least one trap door is automatically opened from a default closed position.

2. The secure mailbox of claim 1, wherein the card key reader is one from the group consisting of a contact reader and a proximity reader.

3. The secure mailbox of claim 1, wherein the master card encoded with a plurality of unique identifiers is adapted to activate multiple unlocking mechanisms along a postal route.

4. The secure mailbox of claim 1, wherein said card reader is powered by a power source consisting of one from the group of AC power, rechargeable DC battery, non-rechargeable DC battery or DC solar.

5. A secure mailbox, comprising:

a main compartment having a plurality of sides forming an enclosed main compartment;

a front mailbox door hingedly connected to the remainder of said main compartment;

a locking and unlocking mechanism being adapted to lock the front mailbox door to said main compartment when the front mailbox door is in the closed position;

an unlocking activation mechanism coupled to the locking and unlocking mechanism adapted to unlock the front mailbox door; and said unlocking activation mechanism comprising an FOB system, wherein the FOB system further comprises at least one master RF transmitter adapted to output one of a plurality of unique digital signals and at least one subordinate RF transmitter adapted to output a subset of such unique digital signals;

an RF receiver adapted to receive a subset of said unique digital signals;

said RF receiver located proximate to the mailbox and coupled to the locking and unlocking mechanism, said RF receiver operable to unlock the front mailbox door upon receiving a specific digital signal from the master RF transmitter or subordinate RF transmitter a secure drop box compartment located below the main compartment; at least one drop box door hingedly connected to the secure drop box compartment; and the at least one drop box door adapted to lock when in a closed position; and at least one trap door operable by a trap door mechanism; the at least one trap door located between the main compartment and the secure drop box compartment; the trap door mechanism operatively coupled to the FOB system such that after a predetermined amount of time elapses after the FOB system is activated, the at least one trap door is automatically opened from a default closed position.

6. The secure mailbox of claim 5, wherein the master FOB transmitter is operable to activate multiple unlocking mechanisms along a postal route.

7. The secure mailbox of claim 5, wherein said RF receiver is powered by a power source consisting of one from the group of AC power, DC battery or DC solar.

8. The secure mailbox of claim 5 wherein the master RF transmitter and subordinate RF transmitter are one from the group consisting of a wand and key FOB.

9. A secure mailbox, comprising:

a main compartment having a plurality of sides forming an enclosed main compartment;

a front mailbox door hingedly connected to the remainder of said main compartment;

a locking and unlocking mechanism being adapted to latch and lock the front mailbox door to said main compartment;

an unlocking activation mechanism coupled to the locking and unlocking mechanism adapted to unlock the front mailbox door; and said unlocking activation mechanism comprising an RFID system, wherein the RFID system further comprises:

a least one remote master RF transceiver and at least one remote subordinate RF transceiver;

at least one RF module located proximate to said mailbox and coupled to the locking and unlocking mechanism;

said master RF transceiver and subordinate RF transceiver operable to interrogate the RF module;

said RF module adapted to return a unique digital identification;

the master RF transceiver operable to compare the unique digital identification to a set of identifications provided in a table;

the subordinate RF transceiver operable to compare the unique digital identification to a unique identification stored in the subordinate RF transceiver; and said RF module operable to unlock the front mailbox door upon receiving a match acknowledgment signal from either the master RF transceiver or subordinate RF transceiver a secure drop box compartment located below the main compartment; at least one drop box door hingedly connected to the secure drop box compartment; and the at least one drop box door adapted to lock when in a closed position; and at least one trap door operable by a trap door mechanism; the at least one trap door located between the main compartment and the secure drop box compartment; the trap door mechanism operatively coupled to the RFID system such after a predetermined amount of time elapses after the RFID system is activated, the at least one trap door is automatically opened from a default closed position.

10. The secure mailbox of claim 9, wherein the master RF transceiver is operable to activate multiple unlocking mechanisms along a postal route.

11. The secure mailbox of claim 9, wherein said RF module is powered by a power source consisting of one from the group of AC power, DC battery, EM activation or DC solar.

* * * * *

UNITED STATES PATENT AND TRADEMARK OFFICE

CERTIFICATE OF CORRECTION

PATENT NO. : 7,249,705 B2
APPLICATION NO. : 11/161416
DATED : July 31, 2007
INVENTOR(S) : Joseph Dudley It is certified that error appears in the above-identified patent and that said Letters Patent is hereby corrected as shown below:

Title Page, Item (75) Inventors: Should Read:

Joseph Dudley
1109 Chapel Creek Ct.
Richardson, Texas 75080

Signed and Sealed this

Twenty-seventh Day of November, 2007

JON W. DUDAS
*Director of the United States Patent and Trademark Office*